United States Patent [19]

Miyamura

[11] Patent Number: 4,884,619

[45] Date of Patent: Dec. 5, 1989

[54] KNITTING STICKS MADE OF BAMBOO

[76] Inventor: Yoshimori Miyamura, No. 160, Shimokawate, Gifu City, Gifu Prefecture, Japan

[21] Appl. No.: 222,933

[22] Filed: Jul. 22, 1988

[30] Foreign Application Priority Data

Aug. 13, 1987 [JP] Japan ..... 61-202110

[51] Int. Cl.[4] ..... B21G 1/12

[52] U.S. Cl. ..... 163/5; 163/2; 264/154

[58] Field of Search ..... 264/154, 299; 163/1–5

[56] References Cited

U.S. PATENT DOCUMENTS 2,396,412 3/1946 Donisthorpe ..... 163/5 X 2,436,371 2/1948 Amidon ..... 163/5 X

FOREIGN PATENT DOCUMENTS 132678 10/1979 Japan ..... 163/2

*Primary Examiner*—Mark Rosenbaum

*Attorney, Agent, or Firm*—Berman, Aisenberg & Platt

[57] ABSTRACT

A method for the production of bamboo-made knitting sticks provided with a gauge scale comprises the steps of processing a bamboo material into a rod of a round or quadratic shape in cross-section, linearly providing a groove of a concave shape in cross-section in a central surface of said rod, inserting into a bonding to said groove a scale sheet formed of paper, synthetic resin or metal and bearing length readings in cm or mm, casting and curing transparent synthetic resin in said groove to seal said scale sheet in said groove, and finish-processing the surface of the cured synthetic resin to make it uniformly contiguous to the surface of said bamboo material for a knitting stick without any step therebetween and make the circumference of said knitting stick complete, whereby said scale is seen through the cast and cured transparent synthetic resin.

5 Claims, 2 Drawing Sheets

FIG. 1a
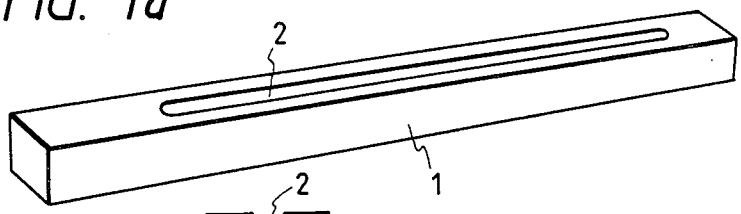
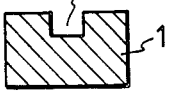
FIG. 1b
FIG. 2
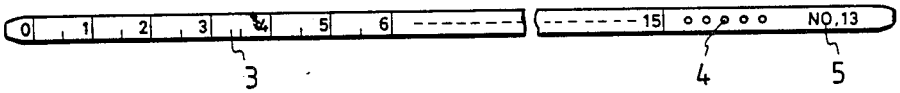
FIG. 3
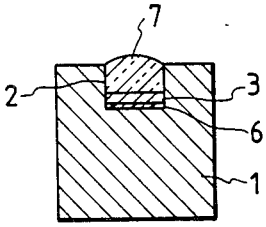
FIG. 4a
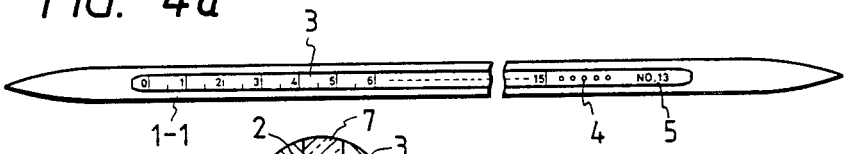
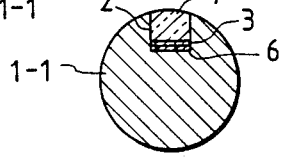
FIG. 4b
FIG. 5a
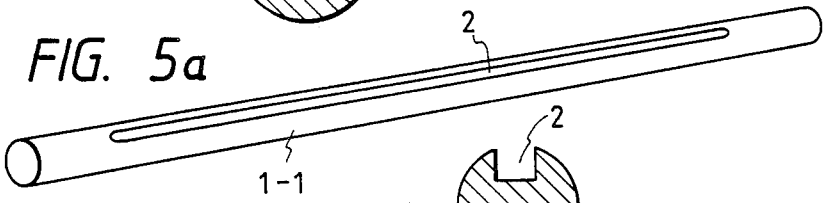
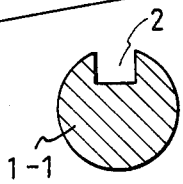
FIG. 5b FIG. 6a
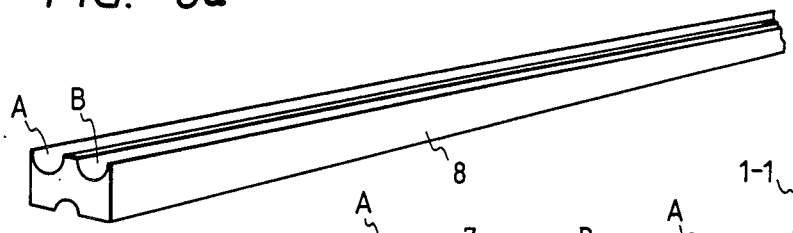
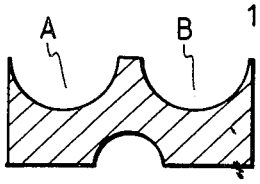
FIG. 6b
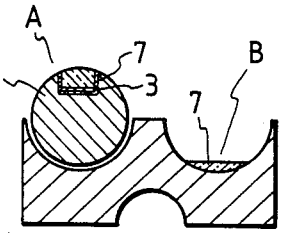
FIG. 6c
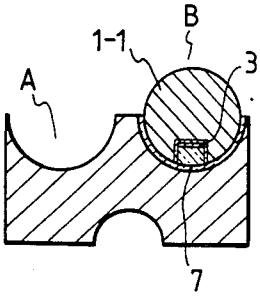
FIG. 6d
FIG. 7a
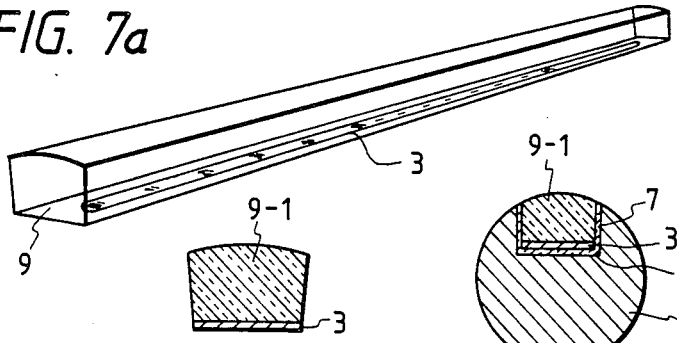
FIG. 7b
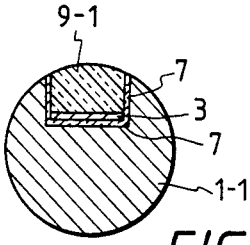
FIG. 7c
FIG. 8a
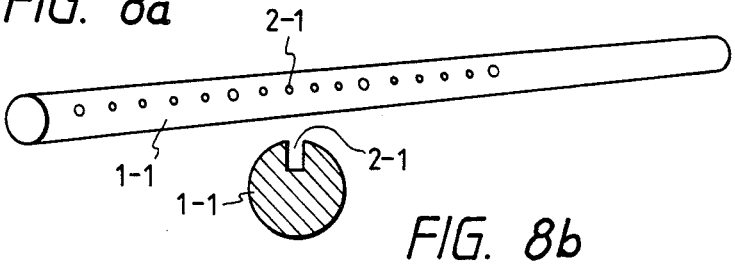
FIG. 8b

KNITTING STICKS MADE OF BAMBOO

BACKGROUND OF THE INVENTION

1. Field of the Invention

This invention relates to a method for preparing knitting sticks made of bamboo, which is provided with a gauge scale for hand-knitting with wool yarn, etc.

2. Statement of the Prior Art

Heretofore, bamboo-made knitting sticks have been widely used for hand-knitting with wool yarn, etc., which is now carried out on the basis of gauges, i.e. the number of stiches per certain interval or length. The gauge currently used in Japan is expressed in terms of the number of stiches per 10 cm such as, for instance, 16×30 of pattern stiches per 10 $cm^2$. For that reason, hand-knitting has been practiced, while suitably counting the number of stiches with a scale set at the end of a knitting stick. This has led to an idea that it may be convenient to provide a knitting stick itself with a gauge scale and, on the basis thereof, it has already been attempted to print a gauge scale on the surface of a knitting stick made of bamboo or plastics with the application of synthetic resin ink.

However, the articles obtained by such a conventional method have had the following demerits:

A. The conventional knitting sticks are so acutely sensitive to finger tips that any smooth feeding of knitting yarn is not achieved.

B. While in use, the scales are likely to be worn out by friction with knitting yarn, etc.

C. Especially in the case of the knitting sticks made of natural bamboo, ink printings on their surfaces are obscure and erasable due to oils and fats or minute irregularities thereon.

The present invention has as its main goal the provision of a solution to the problems of the conventional gauge-scaled knitting sticks.

SUMMARY OF THE INVENTION

The conventional methods for the preparation of gauge scale-incorporating knitting sticks, wherein printings are given to round knitting rods by means of ink, merely relying upon a change in the surfaces of round knitting rods.

According to the present invention, however, a bamboo material is processed into a quadratic rod (FIG. 1) which in turn is or is not formed into a round rod (FIG. 5). Each of the rods is structurally modified or indented for deep markings such as letters or patterns. In other words, it is linearly provided in its central portion opposite to its bark with a groove of a concave shape in cross-section or large and small holes (FIG. 8) at an interval of 1 cm. Then, a scale sheet formed of paper, synthetic resin or metal (FIG. 2) is inserted in such groove or indented portion, into which a transparent, cold-setting synthetic resin is cast to seal and fix the scale sheet. After a transparent, cold-setting synthetic resin has been cast into the groove of a concave shape in cross-section, a scale rod (FIG. 7) formed of transparent synthetic resin and having a scale sheet integrally joined to one side is inserted into said groove for its sealing. The knitting stick is finish-processed by cast molding making use of an injection-molding machine designed to receive in its mold the round rod provided with a groove of a concave shape in cross-section. The round rod is linearly provided on its central surface at an interval of 1 cm with an indented portion for letters and patterns by means of large and small holes or markings; transparent or colored unsaturated polyester resin or the like is cast and filled in such indented portion; and after curing, the resin is made integrally contiguous to the surface of the round rod without any step therebetween by finish-processing.

As stated above, the scale sheet or the like is inserted into an indented portion in the round rod such as a groove, and transparent, cold-setting synthetic resin is cast, sealed and bonded into such groove, whereby the circumference of the round rod is made complete by the surface of said resin made integrally contiguous to the surface of said round rod. The resulting round rod is substantially identical in the touch of finger tips and feeding of wool yarn with an existing well-made bamboo knitting stick.

BRIEF DESCRIPTION OF THE DRAWINGS

FIG. 1*a* is a perspective view of a bamboo rod of a quadratic shape in cross-section, which is provided in its central portion with a groove of a concave shape in cross-section, FIG. 1*b* is a transverse cross section of the rod shown in FIG. 1.

FIG. 2 is a plan view of a scale sheet,

FIG. 3 is a sectional view of the quadratic bamboo rod provided with a groove of a concave shape in cross-section, in which transparent, cold-setting synthetic resin is filled to seal a scale sheet, FIG. 4*a* is a plan view of a finished knitting stick of a round rod obtained by processing of a quadratic rod provided with a groove of a concave shape in cross-section, in which a scale sheet is sealed, FIG. 4*b* is a transverse cross section of the stick shown in FIG. 4*a*.

FIG. 5*a* is a perspective view of a round rod linearly provided with a groove of a concave groove in cross-section, FIG. 5*b* is a transverse cross section of the rod shown in FIG. 5*a*.

FIG. 6*a* is perspective view of a casting frame for casting a transparent, cold-setting synthetic resin into a concave groove in a round rod, FIG. 6*b* is a cross section of the casting frame shown in FIG. 6*a*.

FIG. 6*c* is a cross section of a casting frame shown in FIG. 6*a* and a rod in one step of manufacture.

FIG. 6*d* is a cross section of a casting frame shown in FIG. 6*a* and a rod in another step of manufacture.

FIG. 7*a* is a perspective view of a scale sheet to be inserted in a concave groove in a round rod, and FIG. 7*b* is a transverse cross section of the scale sheet shown in FIG. 7*a*.

FIG. 7*b* is a cross section of a rod having the scale sheet of FIG. 7*a* inserted therein.

FIG. 8*a* is a perspective view of a round rod linearly provided in its center with large and small holes for readings.

FIG. 8*b* is a transverse cross section of the rod shown in FIG. 8*a* taken through one of the holes.

The present invention will now be explained specifically but not exclusively with reference to some embodiments.

EMBODIMENT 1

1. A bamboo material is cut and processed into a rod 1 of a quadratic shape in cross-section. When, by way of example, it is intended to obtain a finished knitting stick No. 13 of 6 mm in diameter the bamboo material is cut to a length of 35 cm with each side of about 6.5 mm to 7.0 mm as shown in FIG. 1.

2. The thus cut quadratic rod 1 is placed in an insulating and drying chamber maintained at 40° to 50° C., and is well dried within such a limit that it does not warp.

3. The thus dried quadratic rod 1 is taken out of the insulating chamber, and is provided with a linear groove 2 of a concave shape in cross-section and certain width and depth in a longitudinal central portion of one of three surfaces except for the bark. The depth and width of the groove 2 may then be determined depending upon the count of the knitting stick to be made. For instance, a width of 2.0 to 3.0 mm and a depth of 1.2 to 1.5 mm are suitable for knitting sticks No. 13.

4. The concave groove is rid of dust and oils and fats.

5. If a previously prepared stick No. 13 is the case, a 21 cm-long, 0.2 to 0.3 mm-thick and 2 mm-wide scale sheet 3 formed of paper, synthetic resin or a metal and bearing readings between locations of 0 cm and 15 cm at intervals of 1 cm, and color-printed markings 4 such as No. 13 (reference numeral 5), a trade mark and supplier's name at a 6-cm location therefrom, is positioned on and bonded to the bottom of the concave groove with the aid of a bonding agent 6, as shown in FIG. 2.

6. Transparent, cold-setting unsaturated polyester resin 7 is mixed with a curing agent and cast in the concave groove to above the brim, thereby sealing the scale sheet. (FIGS. 2–7).

7. About one hour after the resin cast in the concave groove has been cured to such an extent that its surface has not flowed, the rod is placed in an insulating chamber kept at 60° to 65° C. for 10 hours to 15 hours, wherein the cast resin is completely cured and the water content of the bamboo material is reduced to 14% or lower.

8. The quadratic rod, removed from the insulating and drying chamber, is processed by a grinder into a round rod for the knitting stick No. 13 of a 6 mm-diameter circular shape in cross-section as shwon in FIGS. 4*a* and 4*b*.

9. The ends of the round rod are processed for knitting by means of a grinder.

10. The round rod is finish-polished to make the surface of the cast resin uniformly and integrally contiguous to the surface of bamboo material and permit the gauge readings in the groove to be clearly seen through.

EMBODIMENT 2

1. A round rod 1—1 for a knitting stick is formed of a bamboo material.

2. A 2 mm-wide, 1.5 mm-deep and 21 cm-long groove 2 of a concave shape in cross-section is linearly provided in its central portion of the round rod as shown in FIG. 5.

3. A scale sheet 3, as shown in FIG. 2, is positioned on and bonded to the bottom of the thus cut groove with the application of a thin coating of a releasing agent therearound.

4. While the round rod having the scale sheet inserted in the groove is turned upward, the round rod is inserted into a semi-circular groove A in a frame 8, as shown in FIG. 6*a*. The frame is formed of synthetic resin for a knitting stick of each size and has a plurality of identical semi-circular grooves in its longitudinal direction, each groove being a half of the circumference of that knitting stick in cross-section and having a longitudinal length longer than the 21 cm-groove linearly provided in the round rod.

5. Transparent, cold-setting resin 7 such as unsaturated polyester resin or epoxy resin is filled up in the groove in a round rod which has been placed in the semi-circular groove A in the frame 8 as shown in FIG. 6*c*.

6. Subsequently, the same resin 7 is placed in a semi-circular groove B, as shown in FIG. 6*c*, in the same frame 8 in an amount of about one third to one-fourth of the amount filled up in the groove in the round rod.

7. Subsequently, the round rod 1-1 is horizontally taken out of the semi-circular groove A, while its both ends are held by finger tips. Then, the round rod is turned carefully into the adjacent semi-circular groove B with the groove being located just downward as shown in FIG. 6*d*.

8. The round rod is removed from within the semi-circular groove B in 30 to 60 minutes in the case of the unsaturated polyester resin or in about 10 to 15 minutes in the case of epoxy resin after casting, while the cast resin is being cured.

9. Fine deposits along the groove in the thus removed round rod are cleared away by the tip of a bamboo member formed into a knife.

10. After the cast resin has been sufficiently cured, finish-polishing is carried out so as to see through the readings in the groove more clearly.

EMBODIMENT 3

1. A bamboo material to form a knitting stick is processed into a round rod, which is then well dried by sunlight or in a drying chamber kept at 40° to 50° C. to such an extent that it does not warp.

2. A 2 mm-wide, 1.5 mm-deep and 21 cm-long groove of a concave shape in cross-section is linearly provided in its central position of the round rod that is opposite to its bark. (FIG. 5).

3. The groove is cleared of dust, etc.

4. A thin coating of a releasing agent is applied around the round rod except for the interior of the groove.

5. The round rod is held horizontally with the groove being turned upward, and any one of cold-setting epoxy resin, unsaturated polyester resin and resin composed mainly of vinyl acetate, all being transparent, is cast in that groove.

6. Subsequently, a previously prepared scale rod 9 of transparent acryl resin, which has a scale sheet integrally joined to one side and is in such a form as shown in FIG. 7, is inserted and fitted into the groove with the scale sheet being turned downward.

7. Twenty four hours after the initiation of curing of the cast resin, resinous deposits on the surface of the round rod are removed to eliminate any steps between surface of the round rod and that of the scale rod, thereby making the scale rod integral with the circumference of the round rod and, hence, allowing the readings in the groove to be clearly seen through the scale rod as shown in FIG. 7*c*.

EMBODIMENT 4

1. A round rod to form a knitting stick is made of a bamboo material, and is linearly provided in its central surface with a groove of a concave shape in cross-section, into which a similar scale sheet (FIG. 2) as stated above is then inserted for bonding thereto.

2. The round rod made of bamboo material having the scale sheet inserted therein, which is insertable into an injection mold, is set on a semi-automatic injection-molding machine designed to inject transparent acryl resin only into the groove in the round rod.

3. The round rod is removed from the mold per one shot, and is then defined, followed by finish-polishing.

EMBODIMENT 5

1. A round rod of 6 mm in diameter is made according to the preceding embodiments, and is dried in a similar manner.

2. As illustrated in FIG. 8, the round rod is linearly provided in its central portion opposite to its bark with holes 2-1 of 2 mm in diameter and 1.5 mm in depth at an interval of 1 mm. In order to easily see through a linear array of such holes as gauge, the ends of the holes located at 5 cm, 10 cm and 15 cm are numbered 5, 10 and 15, respectively, holes at 10 cm and 15 cm having a diameter of 3 mm respectively.

3. The round rod 8 is fixed horizontally in place with the hole array being turned upward. Then, pieces obtained by cutting a colored paper, synthetic resin or metal to the size of each hole are inserted into the holes, and transparent unsaturated polyester resin, which is or is not colored, is cast in the holes to above their brims.

4. After the cast resin has been sufficiently cured, finish-polishing is carried out so as to make the surface of the resin uniformly and integrally contiguous to the surface of the round rod without any step therebetween, thereby making the circumference of the round rod complete.

EFFECT AND APPLICATION OF THE INVENTION

The bamboo-made knitting sticks provided with a gauge scale according to the present invention are constructed as detailed above. The integrally built-in gauge scale enables the knitting sticks to be used more effectively as compared with other knitting sticks made of plastics, metals and so on without losing their own property of becoming more and more compatible to the hands or wool yarn in repeated use. Further, the color-printed gauge scale and size count markings to be seen through the transparent synthetic resin cast and cured in the groove are clearer and more beautiful partly because of their lens effect, and give attractiveness to the bamboo-made knitting sticks. As described in the preceding embodiments, the knitting sticks according to the present invention are finished by providing a 21 cm-long groove or array of large and small holes in a stick having a full length of 30 to 33 cm and casting and filling therein synthetic resin. Since this results in the prevention of a warping force from acting on the bamboo material, it is possible to substantially avoid the gravest problem with conventional bamboo-made knitting stick articles that some 50% are estimated to be degraded by warping in the process from production to selling. Thus, the method for preparing the bamboo-made knitting sticks according to the present invention is useful in knitting and handcraft arts as well as in the production of bamboo sticks. The technical idea or basic structure underlying the present invention, that is, the method which comprises grooving or indenting a bamboo-made round rod to form a knitting stick, inserting a scale sheet, etc. into the groove or indents and casting and filling therein transparent synthetic resin for sealing, joining and fixing of the scale sheet, is also applicable to the production of knitting sticks made of synthetic resin, wood and metal, not to mention ring and hook needles made of bamboo.

What is claimed is:

1. A method for the production of bamboo-made knitting sticks provided with a gauge scale, which comprises:

processing a bamboo material into a rod of a round or quadratic shape in cross-section, linearly providing a groove of a concave shape in cross-section in a central surface of said rod, inserting into and bonding to said groove a scale sheet formed of paper, synthetic resin or metal and bearing length readings in cm or mm, casting and curing a transparent synthetic resin in said groove to seal said scale sheet in said groove, and finish-processing the surface of the cured synthetic resin to make it uniformly contiguous to the surface of said bamboo material for a knitting stick without any step therebetween and make the circumference of said knitting stick complete, whereby said scale is seen through the cast and cured transparent synthetic resin.

2. A method as claimed in claim 1, which further includes the steps of:

preparing a frame formed of synthetic resin and having a plurality of identical semi-circular grooves in its longitudinal direction, each groove designed to correspond to a knitting stick of each size and having a cross-section equal to $\frac{1}{2}$ of the circumference of said knitting stick and a length longer than that of said linearly-provided groove of a concave shape in cross-section formed in said central surface of a round rod to form a knitting stick, inserting and bonding a scale sheet to the bottom of said groove is said round rod, inserting said round rod into one of said semi-circular grooves in said frame with said groove being turned upward, filling up a transparent, cold-setting synthetic resin in said upward groove, casting the same synthetic resin into the bottom of the other semi-circular groove in said frame in an amount of $\frac{1}{3}$ to $\frac{1}{4}$ of the amount cast into said groove in said round rod, removing said round rod inserted in said one semi-circular groove while holding its both ends by finger tips, and turning it into said other semi-circular groove in said frame with said groove being turned just downward, and removing said round rod while the cast synthetic resin is undergoing a curing reaction, followed by finish-processing.

3. A method as claimed in claim 1, which further includes the steps of:

linearly providing a groove of a concave shape in cross-section in a central surface of a round rod formed by cutting and processing so as to form a bamboo material into a knitting stick, horizontally fixing said round rod with said groove being turned upward, and casting a transparent, cold-setting synthetic resin into said groove, and inserting a scale rod formed of transparent synthetic resin and having a scale sheet integrally joined to one side, followed by finish-processing.

4. A method as claimed in claim 1, which further includes the steps of:

linearly providing a central surface of a round rod formed by cutting and processing so as to form a bamboo material into a knitting stick with a recess for letters or patterns or large and small holes provided at an interval of 1 cm, casting and filling a transparent or colored, cold-setting synthetic resin in said recess, and finish-processing the surface of said resin to make it integrally contiguous to the surface of said round rod without any step therebetween after said resin has been cured.

5. A method as claimed in claim 1, wherein a scale sheet bearing, in addition to readings for hand-knitting gauge and length readings in mm or inch, a size count of said knitting stick, a trade mark, a supplier's name and advertisement, is sealed in the interior of transparent synthetic resin.

* * * * *